US012687088B1

(12) United States Patent
Morrison

(10) Patent No.: US 12,687,088 B1
(45) Date of Patent: Jul. 21, 2026

(54) RETRIEVABLE FREE FALL OPENING DEVICE ASSEMBLY FOR CEMENTING A WELLBORE AND METHODS FOR USE THEREOF

(71) Applicant: FORUM US, INC., Houston, TX (US)

(72) Inventor: Jeffery Morrison, Missouri City, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/179,984

(22) Filed: Apr. 15, 2025

(51) Int. Cl.
*E21B 33/14* (2006.01)
*E21B 23/00* (2006.01)
*E21B 34/14* (2006.01)

(52) U.S. Cl.
CPC ..... *E21B 34/142* (2020.05); *E21B 23/00* (2013.01); *E21B 33/14* (2013.01)

(58) Field of Classification Search
CPC ..... E21B 34/14
See application file for complete search history.

(56) References Cited

U.S. PATENT DOCUMENTS 3,811,500 A 5/1974 Morrisett et al.
3,948,322 A 4/1976 Baker
4,042,014 A 8/1977 Scott
4,669,541 A * 6/1987 Bissonnette ..... E21B 34/14 166/154
4,674,569 A 6/1987 Revils et al.
4,880,058 A 11/1989 Lindsey et al.
5,038,862 A 8/1991 Giroux et al.
5,279,370 A 1/1994 Brandell et al.
5,299,640 A 4/1994 Streich et al.
5,348,089 A 9/1994 Brandell et al.
8,997,882 B2 4/2015 Turley et al.
9,816,351 B2 11/2017 Lirette et al.
(Continued)

FOREIGN PATENT DOCUMENTS

AU 2012217607 B2 11/2015
CA 2 651 966 A1 11/2007
(Continued)

OTHER PUBLICATIONS

International Search Report and Written Opinion dated Feb. 9, 2023 for International Application No. PCT/US2022/079930.
(Continued)

*Primary Examiner* — William D Hutton, Jr.
*Assistant Examiner* — Avi T Skaist
(74) *Attorney, Agent, or Firm* — Patterson + Sheridan, LLP

(57) ABSTRACT

A method for cementing a wellbore includes lowering a stage collar assembly into a wellbore, dropping a retrievable opening device into the wellbore, engaging the retrievable opening device with a seat of the stage collar assembly, opening cementing ports of the stage collar assembly, flowing cement into an annulus between the stage collar assembly and the wellbore via the cementing ports, closing the cementing ports, drilling a first portion of the retrievable opening device to disengage the retrievable opening device from the seat, engaging a second portion of the retrievable opening device with a catching member of the stage collar assembly, wherein the catching member is disposed below the seat, and drilling out the second portion of the retrievable opening device and the catching member.

14 Claims, 9 Drawing Sheets

(56) References Cited

U.S. PATENT DOCUMENTS

| | | | |
|---|---|---|---|
| 10,273,781 | B2 | 4/2019 | Themig et al. |
| 10,309,184 | B2 * | 6/2019 | Waterhouse ..... E21B 34/105 |
| 11,125,048 | B1 | 9/2021 | Giroux et al. |
| 12,024,977 | B2 | 7/2024 | Webber et al. |
| 2002/0166665 | A1 | 11/2002 | Vincent et al. |
| 2006/0169466 | A1 | 8/2006 | Stokley et al. |
| 2010/0051276 | A1 | 3/2010 | Rogers et al. |
| 2013/0233570 | A1 | 9/2013 | Acosta et al. |
| 2014/0034310 | A1 | 2/2014 | Andersen |
| 2015/0060064 | A1 | 3/2015 | Lafferty et al. |
| 2015/0330181 | A1 | 11/2015 | Budde et al. |
| 2015/0345252 | A1 | 12/2015 | Mcnabb et al. |
| 2017/0211349 | A1 | 7/2017 | Themig et al. |
| 2021/0010345 | A1 | 1/2021 | Acosta et al. |
| 2022/0074276 | A1 | 3/2022 | Webber et al. |
| 2022/0349272 | A1 | 11/2022 | Patil et al. |
| 2022/0372843 | A1 | 11/2022 | Anderson |
| 2023/0407725 | A1 | 12/2023 | Massey et al. |
| 2024/0035356 | A1 | 2/2024 | Webber et al. |

FOREIGN PATENT DOCUMENTS

| | | | |
|---|---|---|---|
| GB | 2526208 | A | 11/2015 |
| WO | 2021097017 | A1 | 5/2021 |
| WO | 2021183379 | A1 | 9/2021 |

OTHER PUBLICATIONS

Invitation to Pay Additional Fees for Application No. PCT/US2026/023709 dated Jun. 12, 2026.

* cited by examiner

RETRIEVABLE FREE FALL OPENING DEVICE ASSEMBLY FOR CEMENTING A WELLBORE AND METHODS FOR USE THEREOF

BACKGROUND

Field

The disclosure relates to free fall opening devices (FFOD), and, in particular, a retrievable FFOD assembly and methods for use thereof in cementing operations.

Description of the Related Art

In oil and gas operations, preparing or completing a wellbore before the wellbore can operate includes cementing a casing in the wellbore. Cementing operations use a stage tool assembly to flow cement into an annulus created by the casing and the wellbore. Free fall opening devices (FFOD) can be dropped into the stage tool assembly to help conduct specific steps of the cementing operations. Occasionally, the opening devices fail to seat, seal, or engage properly in a target position. Further, once the opening devices have seated, sealed, or engaged properly in their target positions, it is difficult to remove the entirety of the opening devices from the wellbore after cementing operations. Therefore, there is a need for new and/or improved retrievable FFOD assemblies and methods for use thereof in cementing operations.

SUMMARY

Aspects of the present disclosure relate to a retrievable free fall opening device assembly for cementing a wellbore and methods for use thereof.

In one embodiment, a method for cementing a wellbore, comprising: lowering a stage collar assembly into a wellbore, dropping a retrievable opening device into the wellbore, engaging the retrievable opening device with a seat of the stage collar assembly, opening cementing ports of the stage collar assembly, flowing cement into an annulus between the stage collar assembly and the wellbore via the cementing ports, closing the cementing ports, drilling a first portion of the retrievable opening device to disengage the retrievable opening device from the seat, engaging a second portion of the retrievable opening device with a catching member of the stage collar assembly, wherein the catching member is disposed below the seat, and drilling out the second portion of the retrievable opening device and the catching member.

In one embodiment, an opening device retrieval tool, comprising: a packer, an inner string pressure activated cylinder, and a latching string. The inner string pressure activated cylinder is coupled to and disposed below the packer. The latching string is coupled to and is movable by the inner string pressure activated cylinder. The latching string includes a latching member at a distal end of the latching string.

In one embodiment, a retrievable opening device assembly, comprising an opening device and a catching member. The opening device including a first body portion, a second body portion, a top surface, and a latching member. The first body portion includes a first surface profile. The second body portion is coupled to the first body portion and includes a second surface profile. The top surface is tapered towards a centerline of the opening device. The latching member is disposed on the top surface. The catching member includes a catching profile complementary to the second surface profile to prohibit rotation of the opening device relative to the catching member.

BRIEF DESCRIPTION OF THE DRAWINGS

So that the manner in which the above-recited features of the disclosure can be understood in detail, a more particular description of the disclosure, briefly summaries above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The disclosure contemplates that terms such as "couples," "coupling," "couple," and "coupled" may include but are not limited to welding, interference fitting, magnetic coupling, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 1:
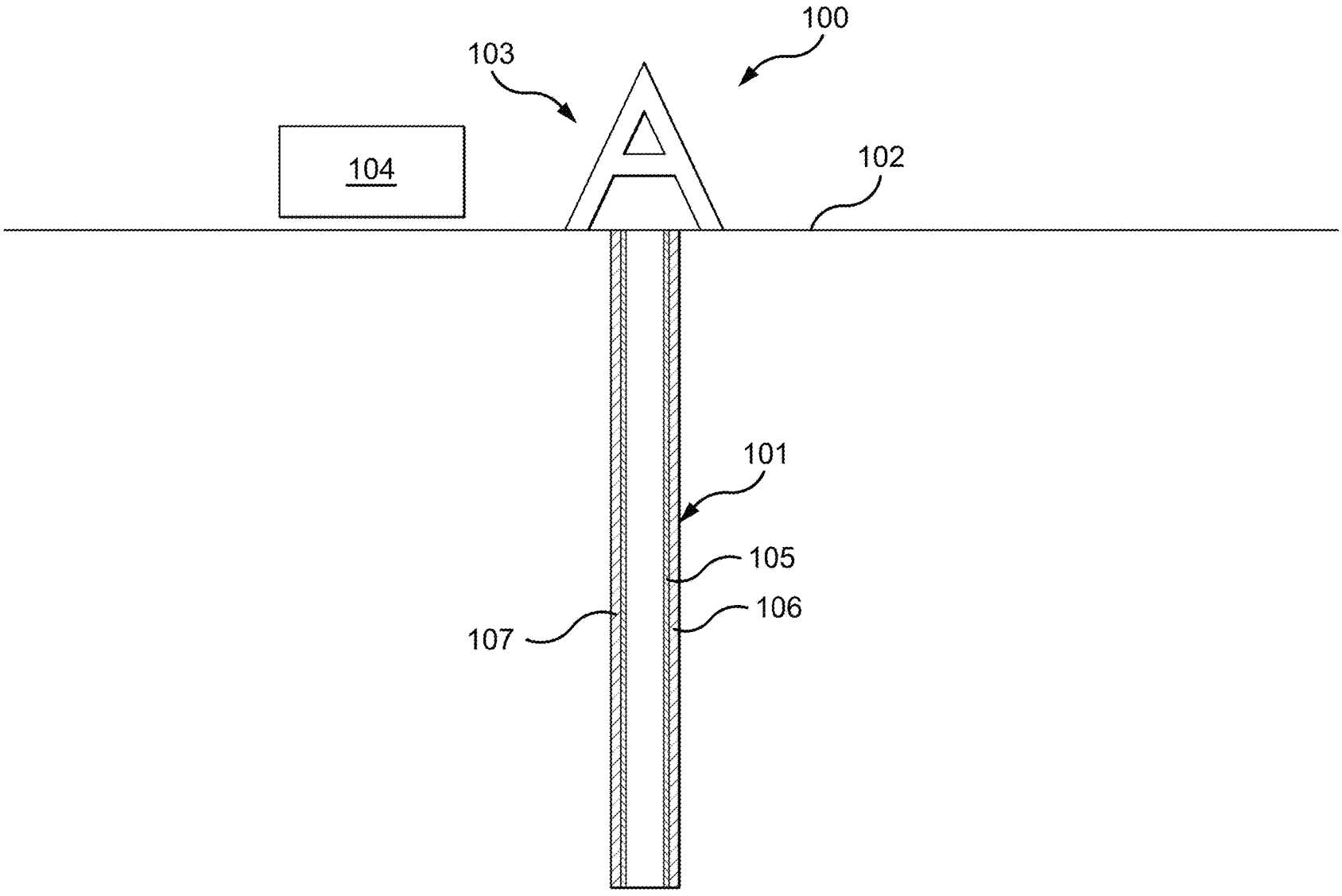
FIG. 1 illustrates a wellbore operation, according to one or more embodiments.

FIG. 1 illustrates a wellbore operation 100, according to one or more embodiments. The wellbore operation 100 includes a wellbore 101 that is drilled from the surface 102 at a well site 103, which may be used for a variety of operations. The well site 103 may include a controller 104 for controlling various operations at the well site 103. To complete the wellbore 101, a casing 105 is lowered into the wellbore 101 and cemented into place by injecting cement 106 into an annulus 107 between the casing 105 and the wellbore 101. One or more stage collar assemblies (such as stage collar assembly 1000 of FIG. 2) are used to cement the casing 105 in the wellbore 101.

Figure 2:
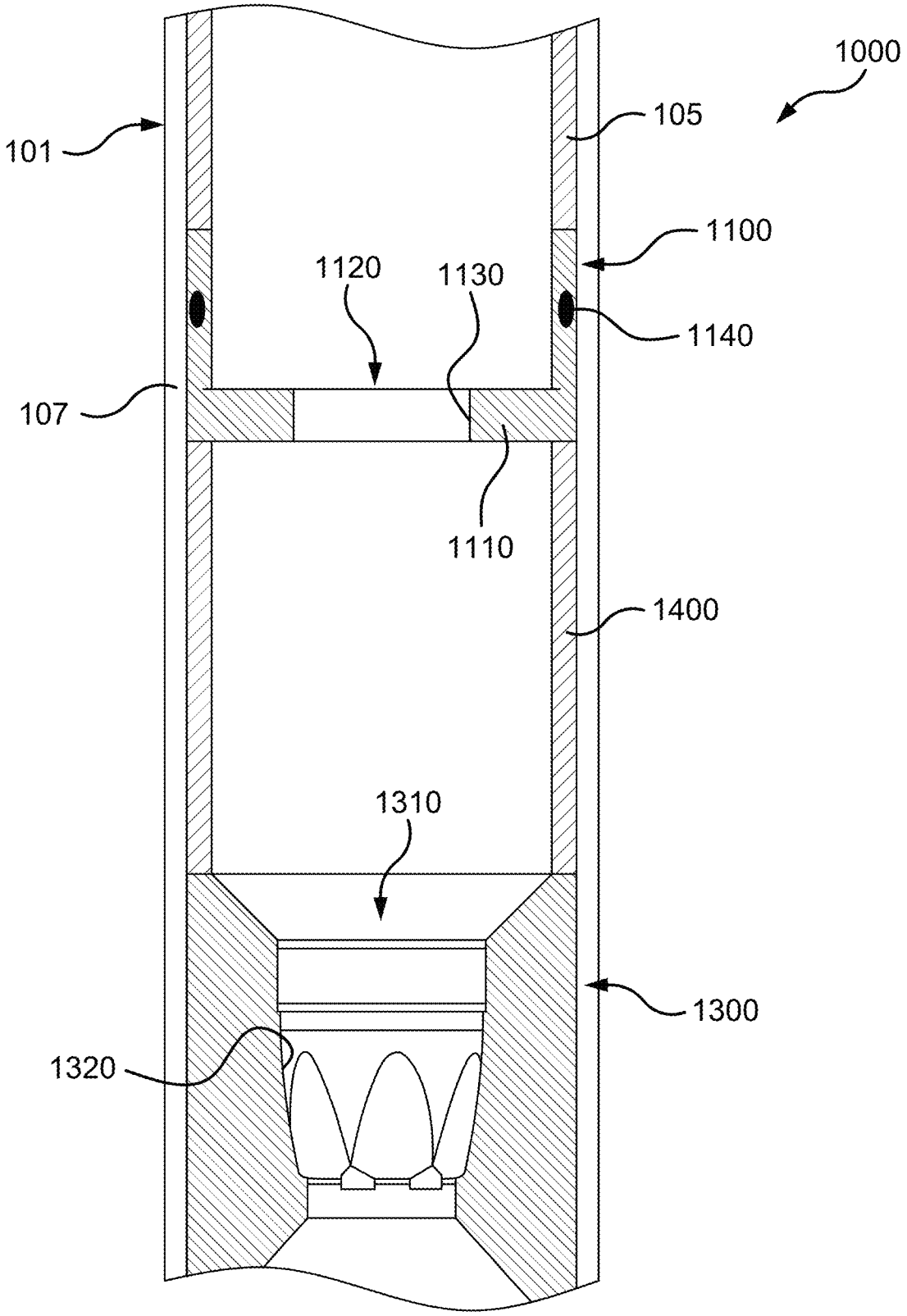
FIG. 2 illustrates a stage collar assembly lowered into a section of the wellbore of FIG. 1, according to one or more embodiments.

FIG. 2 illustrates a stage collar assembly 1000 lowered into a section of the wellbore 101. During the completion of the wellbore 101, the stage collar assembly 1000 is lowered into a section of the wellbore 101 and the stage collar assembly 1000 is cemented in place during a cementing operation. The stage collar assembly 1000 is cemented by flowing cement down the wellbore 101 and into the annulus 107 formed between the stage collar assembly 1000 and the wellbore 101.

The stage collar assembly 1000 includes the casing 105, a stage collar 1100, and a catching member 1300 disposed below the stage collar 1100. The catching member 1300 is coupled to the stage collar 1100 by a mandrel 1400. The catching member 1300 is made of a drillable material, such as cement.

The stage collar 1100 includes a seat 1110. The seat 1110 has an opening 1120 through its center with a diameter configured to receive a retrievable opening device (such as a retrievable opening device 1500 of FIG. 3). When the retrievable opening device is disposed in the seat 1110, the retrievable opening device and the seat 1110 create a seal isolating the section of the stage collar assembly 1000 below the seat 1110 from the section of the stage collar assembly 1000 above the seat 1110. The seat 1110 has a sealing profile 1130 complementary to a profile of the retrievable opening device to enable sealing.

The stage collar 1100 also includes one or more cementing ports 1140, which may be opened and closed. When the cementing ports 1140 are opened, the interior of the stage collar 1100 is in fluid communication with the annulus 107. Cement may be pumped through the cementing ports 1140 into the annulus 107 so that the stage collar 1100 and the casing 105 may be cemented in the wellbore 101. When the cementing ports 1140 are closed, the fluid communication with the annulus 107 is blocked. The cementing ports 1140 may be opened after the retrievable opening device is engaged and seated in the seat 1110. The cementing ports may be opened and/or closed by a number of methods including, but not limited to, pressure actuation of a sliding sleeve of the stage collar assembly 1000, mechanical rotation of a portion of the stage collar assembly 1000, and/or dropping of another opening and/or closing device into the stage collar assembly 1000.

The catching member 1300 similarly has a bore 1310 therethrough configured to catch the retrievable opening device, or a portion thereof, if and/or when the retrievable opening device, or a portion thereof, falls from the seat 1110. The catching member 1300 contains a catching profile 1320. The catching profile 1320 is complementary to a surface profile of the retrievable opening device to prohibit or prevent rotation of the retrievable opening device with respect to the catching member 1300, and/or to enable the retrievable opening device and the catching member 1300 to become rotationally fixed to one another.

Figure 3:
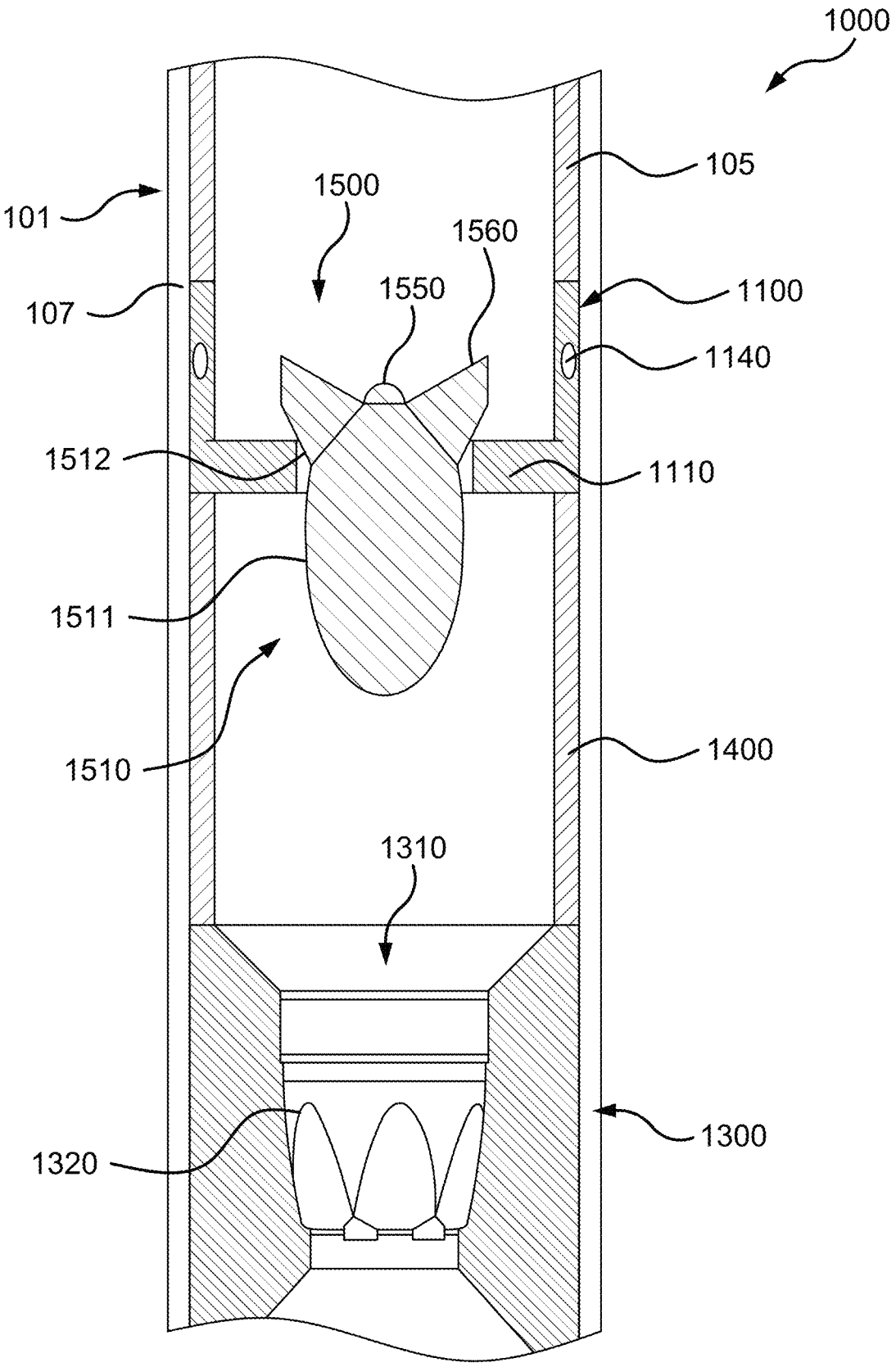
FIG. 3 illustrates a retrievable opening device engaged with the stage collar assembly of FIG. 2, according to one or more embodiments

FIG. 3 illustrates a retrievable opening device 1500 engaged with the seat 1110 of the stage collar 1100. After lowering the stage collar assembly 1000 into place within the wellbore 101, the retrievable opening device 1500 is dropped from the surface 102 (and may be pumped) into the stage collar assembly 1000. The retrievable opening device 1500 has a surface profile 1510 comprising a first surface profile 1511 and a second surface profile 1512. The first surface profile 1511 is complementary to the catching profile 1320 of the catching member 1300 and the second surface profile 1512 is complementary to the sealing profile 1130 of the seat 1110. The second surface profile 1512 is complementary to the sealing profile 1130 of the seat 1110 such that the retrievable opening device 1500 engages with and seals the opening 1120 of the seat 1110 to isolate the section of the stage collar assembly 1000 above the seat 1100 from the section of the stage collar assembly 1000 below the seat 1100.

When the retrievable opening device 1500 properly seats into the seat 1110 by the second surface profile 1512 engaging and sealing with the surface profile 1130 of the seat 1110, the cementing ports 1140 of the stage collar 1100 may be opened to pump cement into the annulus 107 during a cementing operation.

Figure 4:
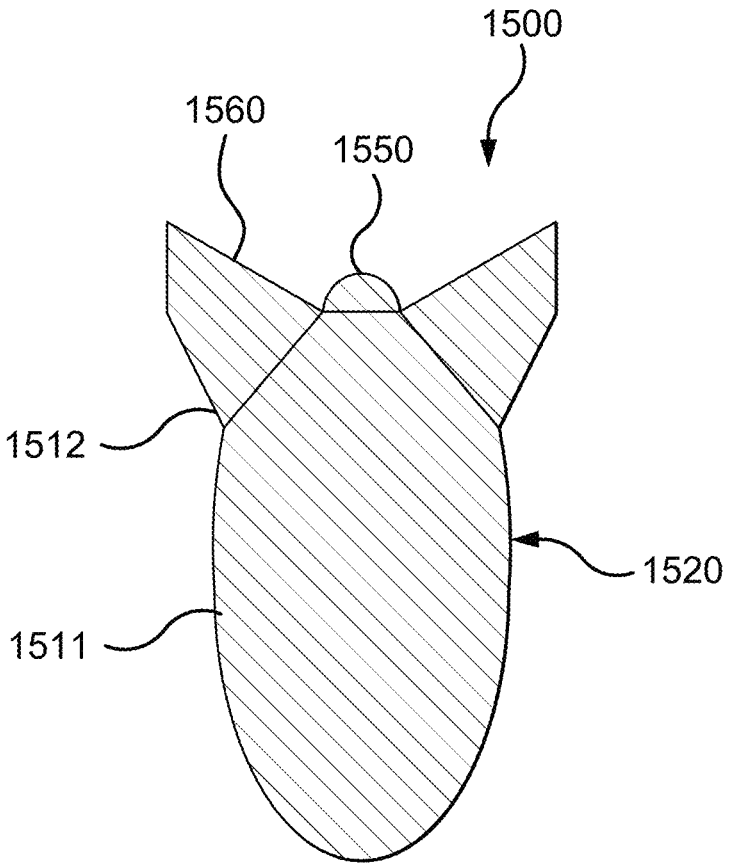
FIG. 4 illustrates a side view of the retrievable opening device of FIG. 3, according to one or more embodiments.

FIG. 4 illustrates side view of the retrievable opening device 1500. The retrievable opening device 1500 includes a body 1520. The body 1520 includes the surface profile 1510 made up of the first surface profile 1511 and the second surface profile 1512. In some embodiments, the first surface profile 1511 and second surface profile 1512 includes surface portions, such as flats or collars, that help orient the retrievable opening device 1500 in the seat 1110 and/or the catching member 1300.

The retrievable opening device 1500 further includes a latching member 1550. The latching member 1550 is engagable with a retrieval tool to retrieve the retrievable opening device 1500 as will be discussed later. In some embodiments, the latching member 1550 is a collet that receives a connector of the retrieval tool. In some embodiments, the latching member 1550 may be a shank or wireline fishing neck to engage with a wireline of the retrieval tool.

The retrievable opening device 1500 also includes a top surface 1560 that is tapered toward the central axis of the retrievable opening device 1500. The top surface 1560 helps guide the retrieval tools towards the central axis to align with, and engage with, the latching member 1550.

Figure 5:
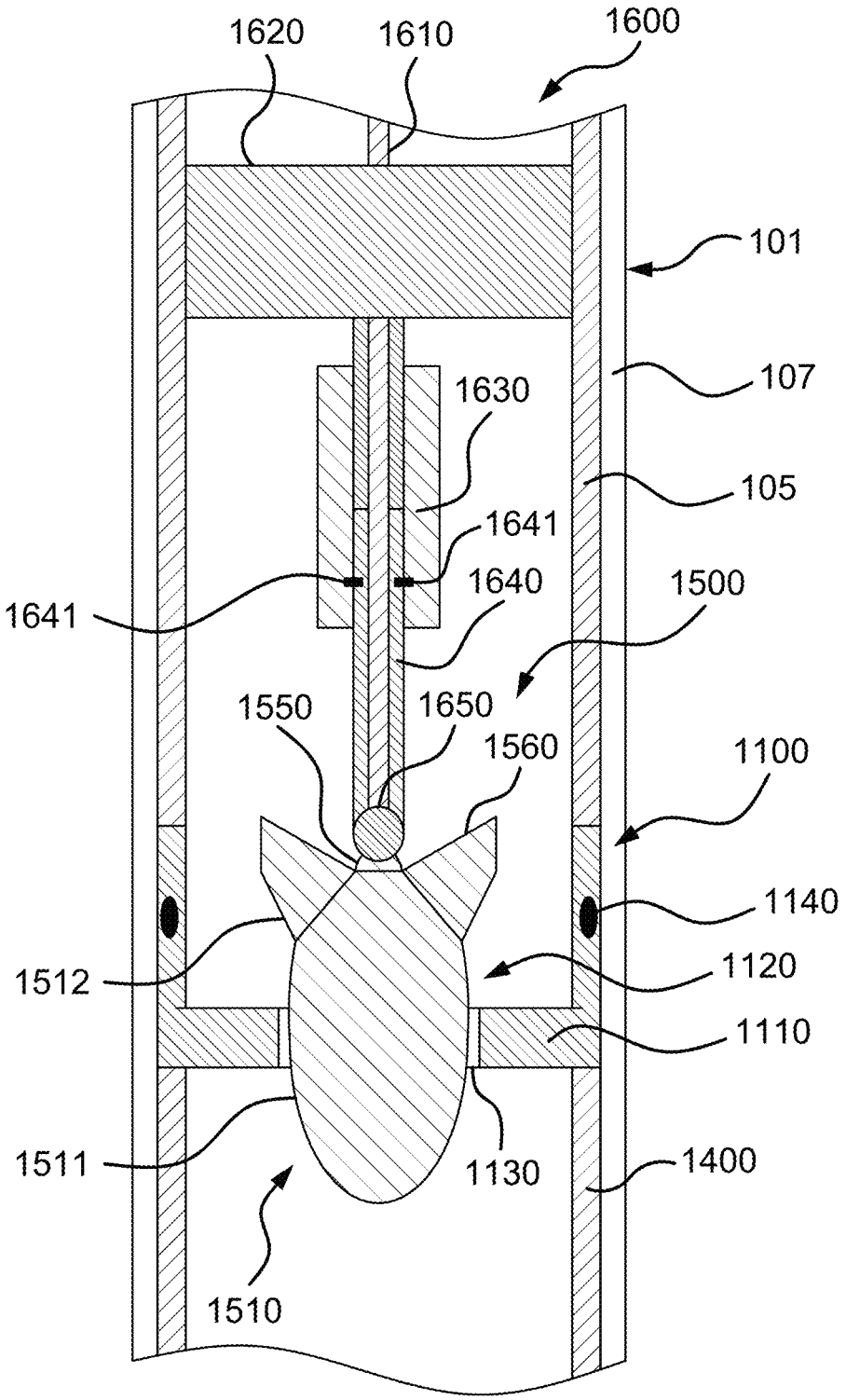
FIG. 5 illustrates a remediation operation, according to one or more embodiments.

FIG. 5 illustrates a remediation operation of the retrievable opening device 1500. If the retrievable opening device 1500 is dropped, and the second profile 1512 of the retrievable opening device 1500 does not seat, engage, and/or seal properly into the sealing profile 1130 of the seat 1110, the remediation operation can be conducted to retrieve the retrievable opening device 1500 and/or re-seat the retrieval opening device 1500. The wellbore 101 above the seat 1100 is not isolated and/or the cementing ports 1140 cannot be opened when the retrievable opening device does not properly engage the sealing profile 1130 of the seat 1110, and therefore the cementing operation may not proceed. When the retrievable opening device 1500 fails seat, seal, and/or engage with the seat 1100, the remediation operation is conducted to remedy the situation. When the second profile 1512 of the retrievable opening device 1500 fails to seat, seal, and/or engage properly into the sealing profile 1130 of the seat 1110, it may be retrieved, adjusted, pushed, moved, and/or manipulated by a retrieval tool 1600 during the remediation operation.

In some embodiments, the retrieval tool 1600 is a wireline that can latch to the retrievable opening device 1500. In some embodiments, such as the embodiment illustrated in FIG. 5, the retrieval tool 1600 is lowered by a wireline 1610 until it has reached the retrievable opening device 1500. The retrieval tool 1600 includes a packer 1620, an inner string pressure activated cylinder 1630, a latching string 1640, and a latching member 1650.

The packer 1620 is a retrievable packer, such as an inflatable packer, a pressure activated packer, an over-pull packer, or a rotationally activated packer. The packer 1620 acts as an anchor for the retrieval tool 1600 during the remediation operation.

The inner string pressure activated cylinder 1630 is coupled to and disposed below the packer 1620. The inner string pressure activated cylinder 1630 may be pressured up to actuate the latching string 1640 and the latching member 1650 into and/or out of engagement with the retrievable opening device 1500.

The latching string 1640 is disposed within a bore of the inner string pressure activated cylinder 1630 and hangs below the inner string pressure activated cylinder 1630. The latching string 1640 is held in place within the inner string pressure activated cylinder 1630 by one or more shear pins 1641. The latching string 1640 may have a stroke of 0 inches to 6 inches. The latching member 1650 is disposed at the distal end of the latching string 1640. The latching member 1650 is complementary to the latching member 1550 of the retrievable opening device 1500. Thus, the latching member 1650 engages with the latching member 1550 of the retrievable opening device 1550 so that the retrieval tool 1600 may move the retrievable opening device 1500.

When the retrieval tool 1600 is pressured up, the latching string 1640 shears the one or more shear pins 1641. After shearing the one or more shear pins 1641, the latching string 1640 is pressured up further to stroke and engage the latching member 1650 of the retrieval tool 1600 with the latching member 1550 of the retrievable opening device 1500. If the retrievable opening device 1500 is not centered, or is askew in any way, the tapered surface 1560 of the retrievable opening device 1500 guides the latching member 1650 of the retrieval tool 1600 into engagement with the latching member 1550 of the retrievable opening device 1500.

If the second profile 1512 of the retrievable opening device 1500 has failed to seat, seal, and/or engage into the seat 1100 properly, a remediation operation may be used to reseat, reseal, or engage the retrievable opening device 1500 with the seat 1110. During the remediation operation, the retrieval tool 1600 is run into the wellbore 101 until it reaches the retrievable opening device 1500. Once the retrieval tool has reached the retrievable opening device 1500, the packer 1620 is activated to anchor the retrieval tool 1600 to the casing 105. The retrieval tool 1600 is then pressured up to shear the one or more shear pins 1641 to allow free movement of the latching string 1640 within the inner string pressure activated cylinder 1630. The retrieval tool 1600 is then further pressured up to move the latching string 1640 and the latching member 1650 into engagement with the latching member 1550 of the retrievable opening device 1500. Once engaged, the inner string pressure activated cylinder 1630 may be used to adjust, such as move, the retrievable opening device 1500 into sealing engagement with the seat 1110.

Once the retrievable opening device 1500 is seated, engaged, and/or sealed properly, the packer 1620 is unset from the casing 105. In some embodiments, the packer 1620 can be unset using pulling, rotation, and/or pressure activated unsetting. After unsetting the packer 1620, the latching member 1650 of the retrieval tool 1600 is disengaged from the retrievable opening device 1500. In some embodiments, disengaging the retrieval tool 1600 includes pressuring up the inner string pressure activated cylinder 1630 even further to disengage the latching member 1650.

In some embodiments, a remediation operation includes a different retrieval tool, such as a wireline, running into the wellbore 101 to engage with the retrievable opening device 1500 to lift the retrievable opening device 1500 out of the wellbore 101, or to lift and re-drop the retrievable opening device 1500.

After the remediation operation is completed, the retrieval tool 1600 is removed from the wellbore 101 to continue the cementing operation.

Figure 6:
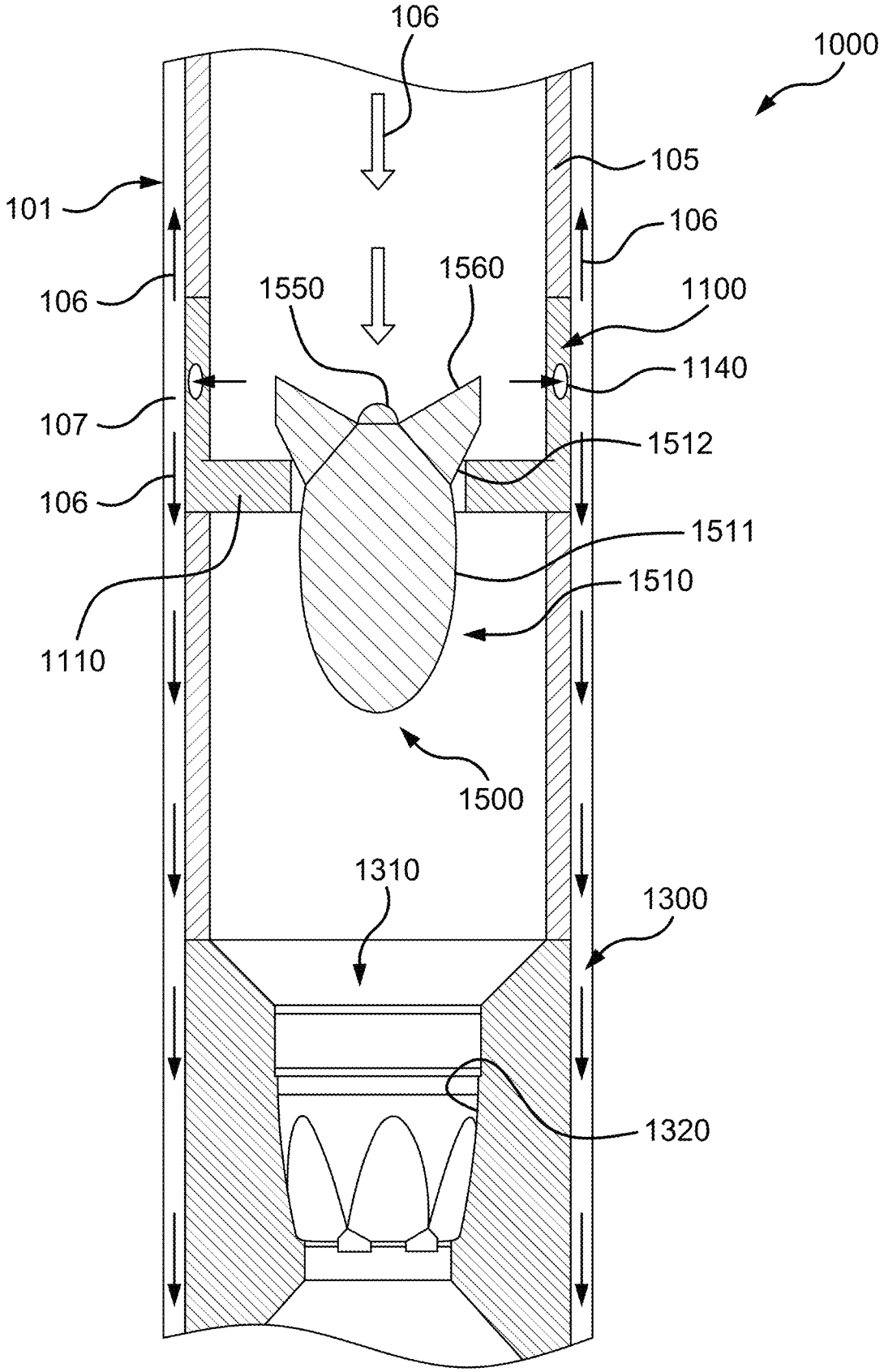
FIG. 6 illustrates a cementing operation using the stage collar assembly of FIG. 2, according to one or more embodiments.

FIG. 6 illustrates cementing the stage collar assembly 1000 in the wellbore 101. Once the second profile 1512 of the retrievable opening device 1500 is seated properly in the sealing profile 1130 of the seat 1110, the cementing ports 1140 are opened allowing fluid communication between the interior of the stage collar 1100 and the annulus 107. Cement 106 is then pumped from the surface 102 through the casing 105 towards the stage collar 1100. The retrievable opening device 1500 blocks cement 106 from flowing past the stage collar 1100 and redirects the cement 106 through the cementing ports 1140 to cement the annulus 107.

Once the annulus 107 is sufficiently cemented, the cementing operation is stopped. In some embodiments, stopping the cementing operation includes dropping a shut-off plug. The shut off plug closes the cementing ports 1140 thus closing fluid communication between the interior of the stage collar 1100 and the annulus 107.

Figure 7:
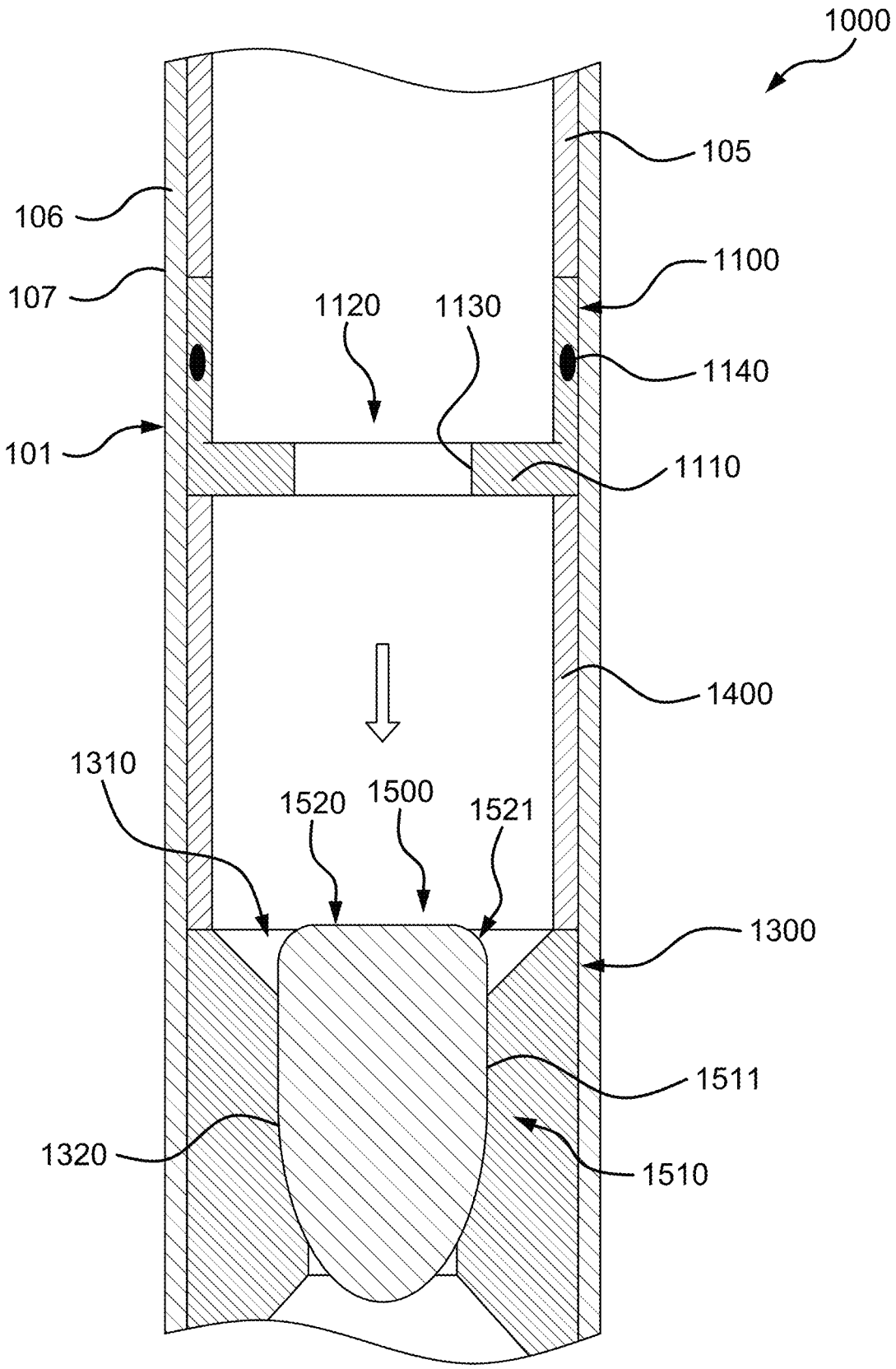
FIG. 7 illustrates a first step in removing the retrievable opening device from the stage collar assembly of FIG. 2, according to one or more embodiments.

FIG. 7 illustrates a first step in removing the retrievable opening device 1500 to continue to complete the wellbore 101. After cementing is stopped, a drill string is lowered into the wellbore 101. The drill string is then activated to drill at least a portion of the retrievable opening device 1500 out of the seat 1110. Due to the shape of the retrievable opening device 1500 and the seat 1110, only a portion of the body 1520 of the retrievable opening device 1500 is drilled and the remaining portion of the body 1521 falls from the seat 1100 and is caught by the catching member 1300. The remaining portion of the body 1521 includes the first surface profile 1511, which is complementary to the catching profile 1320 of the catching member 1300. The contact between the first surface profile 1511 and the catching profile 1320 may rotationally fix the remaining portion of the body 1521 with the catching member 1300.

In some embodiments where the above-described cementing operation is a second stage cementing after a first stage, the catching member 1300 and corresponding catching profile 1320 may be a shut-off plug from the previous stage of cementing.

Figure 8:
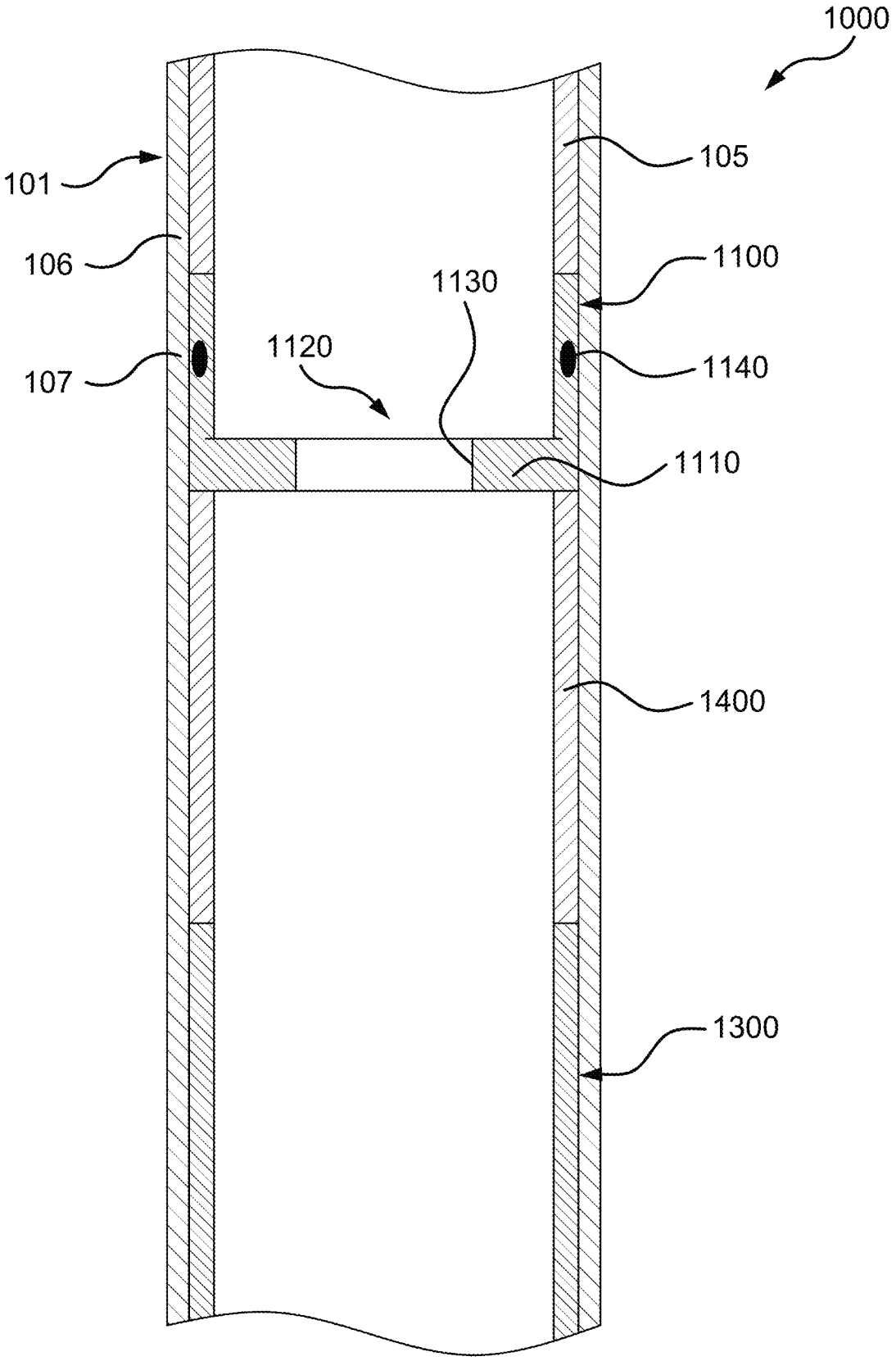
FIG. 8 illustrates a second step in removing the retrievable opening device from the stage collar assembly of FIG. 2, according to one or more embodiments.

FIG. 8 illustrates a second step in removing the retrievable opening device from the stage collar assembly 1000. After the remaining portion of the body 1521 of the retrievable opening device 1500 falls into the catching member 1300, the same drill string, or another drill string, is lowered through the stage collar 1100 into engagement with the top side of the remaining portion of the body 1521 of the retrievable opening device 1500, which is now engaged with the catching member 1300. The force and rotation applied to the top side of the remaining portion of the body 1521 may cause the first profile 1511 to engage with the catching profile 1320 of the catching member 1300, thereby preventing or prohibiting rotation of the remaining portion of the body 1521 with respect to the catching member 1300, or alternatively rotationally fixing the pair. Once the remaining portion of the body 1521 of the retrievable opening device 1500 and the catching member 1300 are rotationally fixed, the drill string drills out both the remaining portion of the body 1521 of the retrievable opening device 1500 and the catching member 1300 together thus opening flow through the stage collar assembly 1000 for further completion steps or operation of the wellbore 101.

Figure 9:
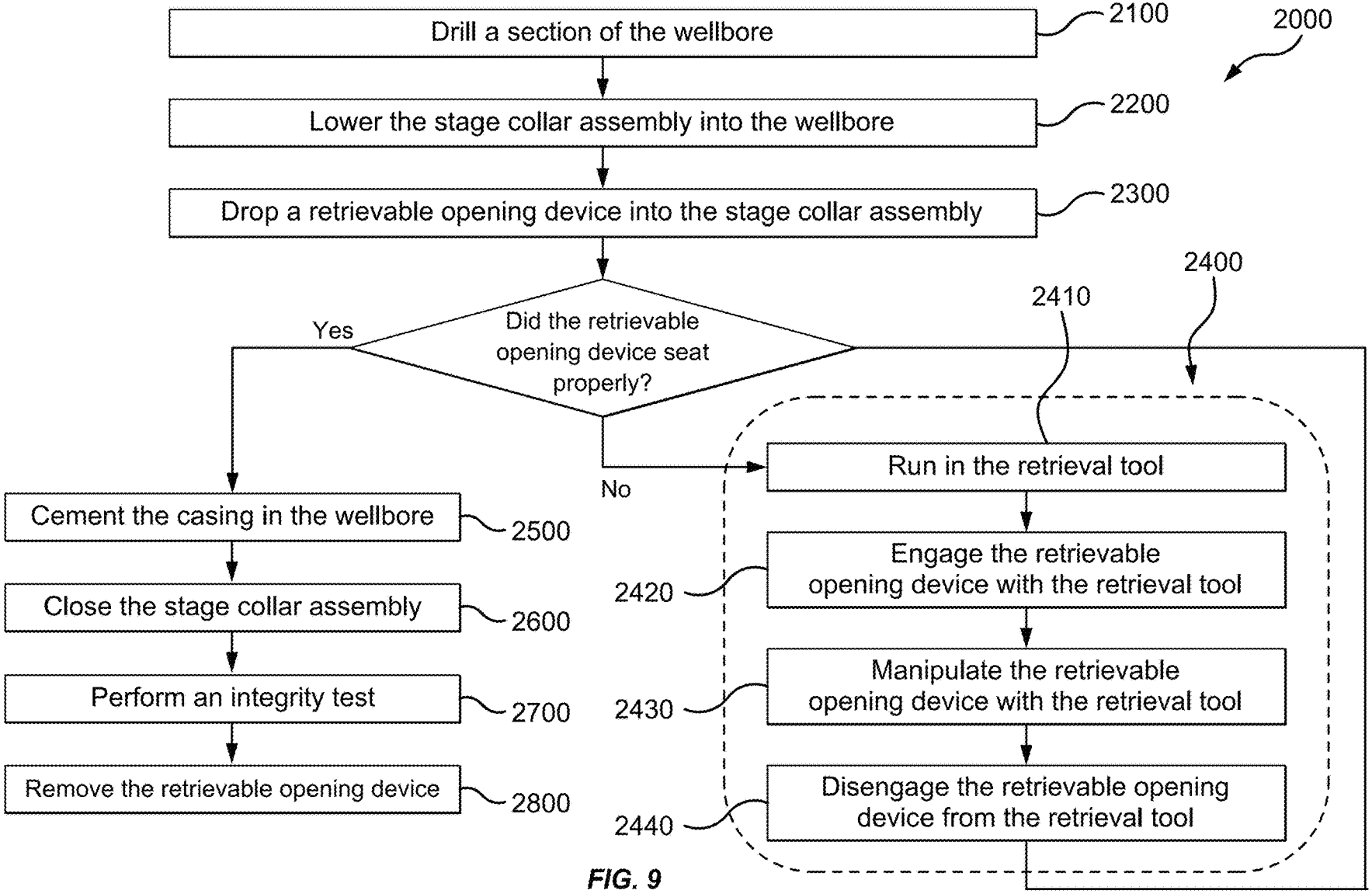
FIG. 9 illustrates a method of cementing a section of a wellbore, according to one or more embodiments.

FIG. 9 illustrates a method 2000 for cementing a section of a wellbore (such as wellbore 101 of FIG. 1). In step 2100, a section of the wellbore is drilled. In step 2200, a stage collar assembly (such as stage collar assembly 1000 of FIG. 2) is lowered into the wellbore until it has reached a desired depth. In some embodiments, fluid is pumped while the stage collar assembly is lowered into the wellbore. The stage collar assembly includes a section of casing (such as casing 105 of FIG. 2), a stage collar (such as stage collar 1100 of FIG. 2) which includes a seat (such as seat 1110 of FIG. 2) and cementing ports (such as cementing ports 1140 of FIG. 2), and a catching member (such as catching member 1300 of FIG. 2) which is disposed downhole of the seat and coupled to the stage collar by a mandrel (such as mandrel 1400 of FIG. 2).

In step 2300, a retrievable opening device (such as retrievable opening device 1500 of FIG. 3) is dropped from the surface (such as surface 102 of FIG. 1). The retrievable opening device is configured to land and seat in the seat of the stage collar engaging a second surface profile (such as second surface profile 1512 of the retrievable opening device 1500 of FIG. 3) with a sealing profile of the seat (such as sealing profile 1130 of the seat 1100 of FIG. 2), thereby isolating the section of the stage collar assembly above the seat from the section of the stage collar assembly below the seat. If the opening device does not properly seat, engage, and/or seal in the seat, the retrievable opening device may be repositioned via a remediation operation 2400.

At step 2410 of the remediation operation 2400, a retrieval tool (such as retrieval tool 1600 of FIG. 5) is run into the wellbore. In step 2420 of the remediation operation 2400, the retrieval tool is engaged with the improperly seated retrievable opening device. The retrieval tool is engaged with the retrievable opening device by setting a packer (such as packer 1620 of FIG. 5) that is set in the casing above the retrievable opening device to anchor the retrieval tool. The retrieval tool is then pressured up to shear one or more shear pins (such as one or more shear pins 1641), which are used to couple an inner string pressure activated cylinder (such as inner string pressure activated cylinder 1630 of FIG. 5) to a latching string (such as latching string 1640 of FIG. 5) of the retrieval tool. After shearing the one or more shear pins, the retrieval tool is pressured up to move a latching member (such as latching member 1650 of FIG. 5) located on a distal end of the latching string into engagement with a latching member (such as latching member 1550 of FIG. 4) of the retrievable opening device.

At step 2430 of the remediation operation 2400, the retrieval tool adjusts the position, exerts a force, and/or otherwise manipulates the retrievable opening device into engagement with the seat once the retrieval tool is engaged with the retrievable opening device.

At step 2440 of the remediation operation 2400, the retrieval tool is disengaged from the retrievable opening device once the retrievable opening device is properly seated. Disengaging the retrieval tool from the retrievable opening device includes un-setting the packer from the casing and pressuring up the retrieval tool to disengage the latching member of the retrieval tool from the latching member of the retrievable opening device. The retrieval tool is then removed from the wellbore to continue the cementing operation 2000.

In some embodiments, the steps 2420, 2430, and/or 2440 of the remediation operation 2400 includes running a wireline into the wellbore to engage the retrievable opening device to adjust the retrievable opening device into engagement with the seat. In some embodiments, the wireline may remove the retrievable opening device from the seat, the stage collar assembly, or the wellbore so that the opening device can then be re-dropped.

When the retrievable opening device is seated properly in the seat, the cement ports can be opened. Cement (such as cement 106 of FIG. 6) is flowed through the wellbore at step 2500. The cement is flowed through the stage collar assembly and out of the cementing ports and into an annulus (such as annulus 107 of FIG. 2) formed between the stage collar assembly and the wellbore to cement the stage collar assembly and the casing into the wellbore at the desired depth.

At step 2600 of the remediation operation, the cementing operation is stopped after the desired amount of cement has been pumped into the annulus. Stopping the cementing operation includes closing the cementing ports to close fluid communication between the interior of the stage collar assembly and the annulus. In some embodiments, closing the cementing ports includes dropping a shut-off plug to close the fluid communication. In some embodiments, closing the cementing ports includes actuating the stage collar assembly to close the cementing ports through other methods including, but not limited to, sliding a sleeve, rotating a portion of the stage collar, or otherwise moving one or more components of the stage collar assembly through other means, such as a tool, ball, plug, or hydraulics.

In some embodiments, after stopping the cementing operation, an integrity test is performed at step 2700. The integrity test confirms that the cementing operation is complete and the integrity of the cemented portion of wellbore has sufficient integrity for operation of the wellbore.

After the integrity test is complete, the retrievable opening device is removed from the seat at step 2800. The retrievable opening device is removed by lowering a drill string into the wellbore and drilling a portion of the retrievable opening device from the seat. Due to the size and shape of the seat, a remaining portion of the retrievable opening device body (such as remaining portion 1521 of FIG. 7) falls through the seat and lands in the catching member. The remaining portion of the retrievable opening device includes a first surface profile (such as first surface profile 1511 of FIG. 7) which engages with a catching profile (such as catching profile 1320 of FIG. 2) of the catching member.

After the remaining portion of the retrievable opening device is seated in the catching member, the same or another drill string is lowered through the stage collar into contact with a top portion of the remaining portion of the retrievable opening device. The first surface profile of the remaining portion of the retrievable opening device and the catching profile of the catching member to prevent or prohibit rotation relative to each other, which may be caused by the force and rotation of the drill string. When the remaining portion of the retrievable opening device and the catching member are, at least partially, rotationally fixed, the drill string drills out the retrievable opening device and the catching member together, thereby re-opening flow through the stage collar assembly.

Another section of the wellbore may be cemented or the completion of the wellbore may be resumed once the remaining portion of the retrievable opening device and the catching member are drilled out.

Any one or more components of the stage collar assembly 1000 may be integrally formed together, directly coupled together, and/or indirectly coupled together and are not limited to the specific arrangement of components illustrated in FIGS. 1-8. Any one or more of the components, embodiments, or steps of the stage collar assembly 1000, retrievable opening device 1500 and method 2000 may be combined in whole or part with any other components, embodiments, or steps of the stage collar assembly 1000, retrievable opening device 1500 and method 2000.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

The invention claimed is:

1. A method for cementing a wellbore, comprising:
lowering a stage collar assembly into a wellbore;
dropping a retrievable opening device into the wellbore;
engaging the retrievable opening device with a seat of the stage collar assembly;
opening cementing ports of the stage collar assembly;
flowing cement into an annulus between the stage collar assembly and the wellbore via the cementing ports;
closing the cementing ports;
drilling a first portion of the retrievable opening device to disengage the retrievable opening device from the seat;
engaging a second portion of the retrievable opening device with a catching member of the stage collar assembly, wherein the catching member is disposed below the seat; and
drilling out the second portion of the retrievable opening device and the catching member.

2. The method of claim 1, further comprising conducting a remediation operation with a retrieval tool after dropping the retrievable opening device.

3. The method of claim 2, wherein the remediation operation comprises:
running the retrieval tool into the wellbore;
engaging the retrievable opening device with the retrieval tool;
adjusting a position of the retrievable opening device with the retrieval tool; and
releasing the retrievable opening device from the retrieval tool.

4. The method of claim 3, wherein adjusting the position of the retrievable opening device comprises applying a force to the retrievable opening device.

5. The method of claim 4, wherein applying the force to the retrievable opening device comprises pressurizing the retrieval tool to apply the force on a top surface of the retrievable opening device.

6. The method of claim 3, wherein the retrieval tool comprises:
a packer;
an inner string pressure activated cylinder coupled to the packer; and
a latching string coupled to and movable by the inner string pressure activated cylinder, wherein the latching string comprises a latching member at a distal end of the latching string.

7. The method of claim 6, wherein engaging the retrievable opening device with the retrieval tool comprises:
setting the packer in a casing of the wellbore;
pressurizing the retrieval tool to stroke the latching string toward the retrievable opening device; and
coupling the latching member to the retrievable opening device.

8. The method of claim 7, wherein engaging the retrievable opening device with the retrieval tool further comprises pressurizing the retrieval tool to shear one or more shear pins between the latching string and the inner string pressure activated cylinder before stroking the latching string toward the retrievable opening device.

9. The method of claim 3, wherein the retrieval tool is a wireline.

10. The method of claim 3, wherein adjusting the position of the retrievable opening device with the retrieval tool comprises lifting the retrievable opening device and re-dropping the retrievable opening device.

11. The method of claim 1, wherein:
the retrievable opening device comprises a first surface profile and a second surface profile; and
engaging the retrievable opening device with the seat comprises engaging the first surface profile with a sealing profile of the seat.

12. The method of claim 1, wherein engaging the second portion of the retrievable opening device with the catching member comprises prohibiting rotation of the retrievable opening device relative to the catching member.

13. The method of claim 12, wherein:
the second portion of the retrievable opening device comprises a surface profile; and
prohibiting rotation of the retrievable opening device relative to the catching member comprises engaging the surface profile of the second portion of the retrievable opening device with a catching profile of the catching member to prohibit rotation of the retrievable opening device with respect to the catching member.

14. The method of claim 1, wherein the catching member comprises a shut-off plug from a previous cementing operation.

* * * * *